US011091304B2

(12) United States Patent
Chisholm et al.

(10) Patent No.: US 11,091,304 B2
(45) Date of Patent: Aug. 17, 2021

(54) CONTAINER CLOSURE WITH VACUUM-INDICATING PULL TAB

(71) Applicant: Owens-Brockway Glass Container Inc., Perrysburg, OH (US)

(72) Inventors: Brian J Chisholm, Sylvania, OH (US); Susan L Smith, Rossford, OH (US)

(73) Assignee: Owens-Brockway Glass Container Inc., Perrysburg, OH (US)

( * ) Notice: Subject to any disclaimer, the term of this patent is extended or adjusted under 35 U.S.C. 154(b) by 35 days.

(21) Appl. No.: 15/860,359

(22) Filed: Jan. 2, 2018

(65) Prior Publication Data

US 2019/0202612 A1 Jul. 4, 2019

(51) Int. Cl.

*B65D 55/02* (2006.01)
*B65D 79/00* (2006.01)
*B65D 77/20* (2006.01)

(52) U.S. Cl.

CPC ..... *B65D 55/026* (2013.01); *B65D 55/024* (2013.01); *B65D 77/2024* (2013.01); *B65D 77/2028* (2013.01); *B65D 79/005* (2013.01); *B65D 2201/00* (2013.01); *B65D 2577/205* (2013.01); *B65D 2577/2058* (2013.01)

(58) Field of Classification Search

CPC ..... B65D 51/20; B65D 2251/0021; B65D 2251/0093; B65D 2251/0028; B65D 55/026; B65D 55/024; B65D 77/2024; B65D 77/2028; B65D 79/005; B65D 2577/205; B65D 2201/00; A47J 47/04

USPC ..... 220/254.3, 651

See application file for complete search history.

(56) References Cited

U.S. PATENT DOCUMENTS 4,298,845 A * 11/1981 Laude ..... H01S 3/0812 372/53
4,940,158 A * 7/1990 Farrell ..... B65D 51/20 220/258.2
4,960,206 A * 10/1990 Johannes ..... B65D 55/028 206/459.1
4,989,974 A 2/1991 Anton et al.
5,697,509 A 12/1997 Hayes
5,702,015 A 12/1997 Giles et al.
6,179,139 B1 1/2001 Heilman
(Continued)

FOREIGN PATENT DOCUMENTS

DE 599822 C 7/1934
DE 3212990 A1 11/1982
(Continued)

OTHER PUBLICATIONS

Written Opinion & International Search Report for PCT/US2018/065602 dated Mar. 25, 2019, 16 pages.
(Continued)

*Primary Examiner* — Shawn M Braden

(57) ABSTRACT

A package that includes a container and a container closure having a vacuum-indicating pull tab. The container includes a longitudinal axis extending therethrough, a mouth, and a sealing surface. The container closure includes a seal membrane sealingly and removably coupled to the container sealing surface to seal the container, and a pull tab configured to extend from the seal membrane. Manipulation of the pull tab provides an indication of the presence or absence of a vacuum in the package.

28 Claims, 5 Drawing Sheets

(56) References Cited

U.S. PATENT DOCUMENTS

| | | | | |
|---|---|---|---|---|
| 6,761,279 | B1 * | 7/2004 | Martin | B65D 43/169 220/254.3 |
| 7,699,845 | B2 * | 4/2010 | Podmore | A61N 7/022 606/41 |
| 2004/0076721 | A1 | 4/2004 | Rosenfeld et al. | |
| 2006/0138068 | A1 | 6/2006 | Tsai et al. | |
| 2008/0041861 | A1 * | 2/2008 | Crawford | B65D 21/022 220/697 |
| 2008/0110896 | A1 * | 5/2008 | Westphal | B65D 51/20 220/359.2 |
| 2011/0000914 | A1 | 1/2011 | Jouillat | |
| 2012/0211386 | A1 | 8/2012 | Haimi | |
| 2015/0284136 | A1 * | 10/2015 | Frishman | B65D 41/42 220/272 |
| 2016/0178057 | A1 | 6/2016 | Sabotta et al. | |
| 2017/0297804 | A1 * | 10/2017 | Love | B65D 81/28 |
| 2018/0079576 | A1 * | 3/2018 | Cassidy | B65B 7/2878 |
| 2018/0118439 | A1 * | 5/2018 | Thorstensen-Woll | B32B 27/36 |

FOREIGN PATENT DOCUMENTS

| | | | |
|---|---|---|---|
| EP | 0357276 | A1 | 3/1990 |
| GB | 2198541 | A | 6/1988 |
| IT | UA20163814 | A1 | 11/2017 |
| WO | WO9631406 | A1 | 10/1996 |
| WO | WO2011148001 | A1 | 12/2011 |

OTHER PUBLICATIONS

European Office Action, Application No. 18834110.1-1016, Applicant: Owens-Brockway Glass Container Inc., dated Jun. 1, 2021.

* cited by examiner

CONTAINER CLOSURE WITH VACUUM-INDICATING PULL TAB

The present disclosure is directed to sealed packages and, more particularly, to packages having a container closure with a vacuum-indicating pull tab.

BACKGROUND AND SUMMARY OF THE DISCLOSURE

It is well known that the container of a sealed package, for example, a glass container, may be filled using what is commonly known as a "hot-fill" process. In such a process, the contents to be packaged in the container are introduced into the container at an elevated temperature. Once filled, the contents of the container may cool naturally or be subject to a cooling process.

It is also well known that hot-filled containers may be sealed with a seal membrane, for example, a foil membrane, thereby forming a sealed package. In some instances, the container may be sealed immediately after the filling of the container and before the cooling of the contents of the container. For containers sealed in this way, the cooling of the contents in the container causes both hot gas and the contents in the container to condense. This, in turn, causes a vacuum to be formed in the package. The vacuum draws the seal membrane into a concave parabolic shape that is maintained so long as a vacuum is maintained within the package; when the vacuum is lost, the seal membrane returns to a non-parabolic shape. However, in certain instances and with seal membranes made of certain materials, the parabolic shape may also be maintained even if there is a loss of vacuum, as the seal membrane has deformed and taken the shape of the parabola. For example, in an instance where there is, for example, a puncture in the seal membrane (e.g., foil) or a failure of the seal between the seal membrane and the sealing surface of the container, and no external forces are applied, the seal membrane may nevertheless maintain the parabolic shape even though the seal has been compromised, and thus, the vacuum within the package is lost.

A general object of the present disclosure, in accordance with at least one aspect of the disclosure, is to provide a closure for a container that allows for a determination to be made as to whether or not a vacuum is present or absent from the package. The determination as to whether or not a vacuum is present or absent within the package is shown by the seal membrane returning to its pre-cooled shape, i.e., non-parabolic.

The present disclosure embodies a number of aspects that can be implemented separately from, or in combination with, each other.

In accordance with one aspect of the disclosure, a package is provided that includes a container and a container closure. The container includes a longitudinal axis extending therethrough and has a mouth and a sealing surface. The container closure comprises a seal membrane sealingly and removably coupled to the sealing surface of the container to seal the container, and a vacuum-indicating pull tab configured to extend from the seal membrane. Manipulation of the vacuum-indicating pull tab provides an indication of the presence or absence of a vacuum in the package.

In accordance with another aspect of the disclosure, there is provided a food or beverage container closure. The container closure includes a seal membrane configured to be removably coupled to a sealing surface of a container, and a vacuum-indicating pull tab configured to extend from said seal membrane.

In accordance with yet another aspect of the disclosure, a package is provided that includes a container and a container closure. The container includes a longitudinal axis extending therethrough and has a mouth and a sealing surface. The container closure comprises a seal membrane sealingly and removably coupled to the sealing surface of the container to seal the container, and a pull tab configured to extend from, and releasably attached to, the seal membrane at a location that is radially-inward of an outer edge of the seal membrane. The container has a product package therein that creates a vacuum the package that draws the seal membrane toward the product causing the seal membrane to assume a parabolic shape. Manipulation of the pull tab provides an indication of the presence or absence of vacuum in the package.

BRIEF DESCRIPTION OF THE DRAWINGS

The disclosure, together with additional objects, features, advantages and aspects thereof, will be best understood from the following description, the appended claims, and the accompanying drawings, in which:

FIGS. 8 and 9 are isometric views of a portion of another package that includes a container and a container closure having a vacuum-indicating pull tab that is fixedly-coupled or integrally-formed with the container closure, wherein FIG. 8 shows the presence of a vacuum in the package and FIG. 9 shows an absence of a vacuum in the package.

DETAILED DESCRIPTION

Figure 1:
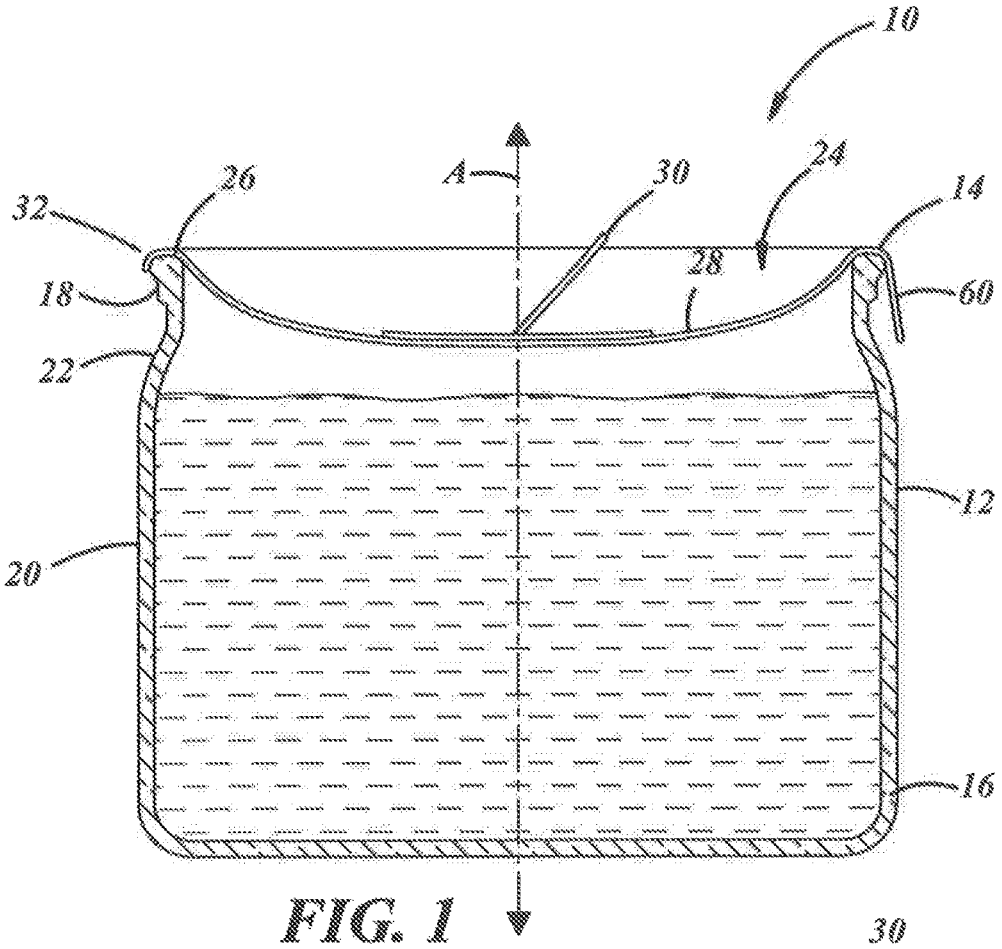
FIG. 1 is a cross-sectional view of a package that includes a container and a container closure having a vacuum-indicating pull tab.

FIG. 1 illustrates a package 10 comprising a container 12 and a container closure 14 that is removably and sealingly coupled to the container 12. The package 10 is configured to package any number of goods—for example, food or beverage products—and may be composed of glass, plastic or any other material suitable for containing food or beverage products that are hot-filled, and may comprise a bowl, a jar, or a bottle, to cite a few possibilities.

The container 12 may include a base 16, a finish 18, and a body 20 extending from the base 16 to the finish 18. The container 12 further includes or defines a longitudinal axis A extending between and through the base 16 and the finish 18.

In certain embodiments, the container 12 may also include a shoulder 22 extending from body 20, and/or a neck (not shown) extending from the shoulder 22 or directly from the body 18. In the illustrated embodiment, the finish 18 of the container 12 extends axially from the shoulder 22 and includes an open mouth 24 surrounded by a sealing surface or lip 26. In an embodiment, the sealing surface 26 is an axially-facing surface that faces away from the container base 16, while in other embodiments, the sealing surface 26 may be radially-facing or otherwise arranged or oriented relative to the longitudinal axis A of the container 12. In any event, the sealing surface 26 is configured to have a portion of the container closure 14 secured and sealed thereto, as will be described more fully below. The container 12 may be composed of glass, plastic, or any other material suitable for containing the products packaged therein.

With continued reference to FIG. 1, the container closure 14 includes a seal membrane 28 and a vacuum-indicating pull tab 30. The seal membrane 28 is configured to be sealingly and removably coupled to the sealing surface 26 of the container 12, and, in an embodiment, is either conduction or induction sealed to the sealing surface 26. Accordingly, in an embodiment, an outer edge, margin, or periphery 32 of the seal membrane 28 is secured to the container sealing surface 26 and the remainder of the seal membrane 28 overlies the mouth 24 of the container 12 and serves to seal the container 12. In another embodiment, the seal membrane 28 may be secured to the container sealing surface 26 at a location on the seal membrane 28 which is radially inward of the outer edge, margin, or periphery 32 of the seal membrane 28 and in such an instance, the periphery 32 of the seal membrane 28 may extend radially outwardly of the finish 18. The seal membrane 28 may be composed of any number of materials suitable for hermetically sealing the container 12, for example, foil, a foil laminate, or a polymeric material (e.g., plastic), to cite a few possibilities.

As briefly described above, products that are hot-filled may be packaged in the package 10, and the container 12 thereof, in particular. As also described above, in a hot-fill process, the contents to be packaged in the container 12 are introduced into the container 12 at an elevated temperature. Once filled, the contents of the container 12 may cool naturally or be subject to a cooling process. For containers that are sealed with a container closure immediately after the hot-filling of the container and before the cooling of the contents therein, the cooling of the contents in the container 12 causes both hot gas and the contents in the container 12 to condense. This, in turn, causes a vacuum to be formed in the package 10. As illustrated in FIG. 1, the vacuum draws the seal membrane 28 of the container closure 14 into a concave parabolic shape that is maintained so long as a vacuum is maintained within the package 10. However, in certain instances with seal membrane 28 made of materials that stretch or permanently deform, the parabolic shape may also be maintained even upon the loss of vacuum. For example, in an instance where there is, for example, a puncture in seal membrane 28 or a failure of the seal between the seal membrane 28 and the sealing surface 26 of the container 12, and no external forces are applied, the seal membrane 28 may nevertheless maintain the parabolic shape even though the seal has been compromised, and thus, the vacuum within the package 10 is lost. The vacuum-indicating pull tab 30 of the container closure 14 provides a way to determine or assess whether or not a vacuum is present or absent in the package 10. More specifically, manipulation of the pull tab 30 provides an indication of the presence or absence of vacuum in the package 10, even if the seal membrane 28 has a concave parabolic shape (as shown in FIG. 1) that is generally indicative of the presence of a vacuum in the package 10. If the vacuum remains within the package 10, the concave parabolic shape of the sealing membrane 28 will remain when a consumer attempts to move the seal membrane 28 by pulling slightly on the pull tab 30. The pull tab 30 may be affixed to the seal membrane 28 with an adhesive that is weaker than the adhesive which seals the seal membrane 28 to the container sealing surface 26, so that when a consumer pulls the pull tab 30, the pull tab 30 releases from the seal membrane 28 but the concave parabolic shape of the seal membrane 28 does not change, as it remains sealed to the sealing surface 26. However, if the seal membrane 28 has been compromised and the vacuum no longer remains within the package 10, then manipulation of the pull tab 30 by the consumer will deform the concave parabolic shape of the sealing membrane 28 into a convex parabolic shape, and in fact, the seal membrane 28 may be loose enough to be moved back and forth from a generally concave parabolic shape to a generally convex parabolic shape via pushing and pulling the pull tab 30.

In an embodiment, the pull tab 30, or at least a portion thereof, is configured to extend from the seal membrane 28 and may be located radially-inward of the periphery or outer edge 32 of the seal membrane 28. In an illustrative embodiment like that shown in FIG. 1, the pull tab 30 overlaps, or is located at, the center of the seal membrane 28 such that when the seal membrane 28 is coupled with the container 12, the pull tab 30 is coaxially aligned with or overlaps the longitudinal axis A of the container 12.

In some embodiments, the pull tab 30, or at least a portion thereof, is releasably attached to the seal membrane 28. In such an embodiment, the pull tab 30, or the releasably attached portion thereof, is configured to be released upon the application of an amount of pulling force that is sufficient to cause the tab 30 to be released, but that is also less than the amount of force necessary or required to cause the seal membrane 28 to separate from the sealing surface 26 of the container 12, thereby avoiding the breakage of the seal and loss of vacuum in the package 10. In such instances, while manipulation of the pull tab 30 provides an indication of the presence or absence of vacuum in the package 10, should excessive force be used during such manipulation, the pull tab 30 would release from seal membrane 28 prior to the separation of the seal membrane 28 from the sealing surface 26 of the container 12, as premature removal of the seal membrane 28 may be undesirable. In other embodiments, the pull tab 30 is not releasably attached but rather is fixedly coupled to the seal membrane 28, or integrally formed therewith using any known methods such as laminating the pull tab 30 during forming of the seal membrane 28 or welding or using adhesive to attach the pull tab 30 onto the seal membrane 28 such that the pull tab 30 is not releasable from the membrane 28 without the application of a force that would cause the seal membrane 28 to separate from the sealing surface 26 and/or cause damage to the seal membrane 28.

Figure 2:
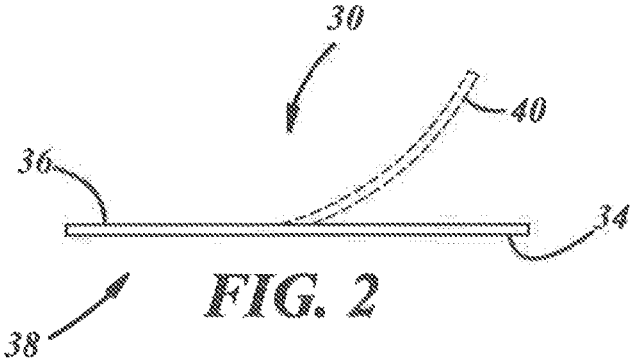
FIGS. 2-4 are diagrammatic views of different illustrative embodiments of a vacuum-indicating pull tab of the container closure illustrated in FIG. 1.

The pull tab 30 may take a number of forms. In the embodiment illustrated in FIG. 2, the pull tab 30 may have a first or bottom surface 34 and a second or top surface 36. A first portion 38 of the pull tab 30 is configured to be attached or affixed to the seal membrane 28. More specifically, a portion of the bottom surface 34 of the pull tab 30 is configured to be attached to the seal membrane 28 by an adhesive, fastener, or other suitable attachment or affixation means. A second portion 40 of the pull tab 30 comprises a grip or graspable portion (grip portion 40). The grip portion 40 is configured to extend from the seal membrane 28 and may be manipulated (e.g., pulled) to determine whether or not a vacuum is present in the package 10.

Figure 3:
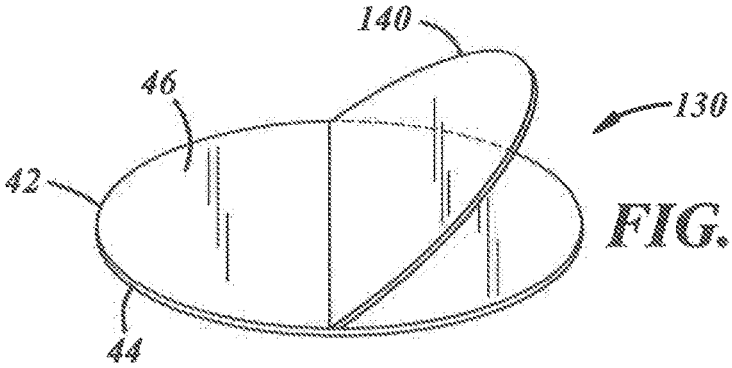

FIG. 3 depicts another illustrative embodiment of the pull tab 30 (i.e., pull tab 130 in FIG. 3). In this embodiment, the pull tab 130 includes a base portion 42 and a grip or graspable portion 40 (i.e., grip portion 140 in FIG. 3). The base portion 42 has a first or bottom surface 44 configured to be attached or affixed to the seal membrane 28 of the container by an adhesive, fastener, or other suitable attachment or affixation means. The base portion 42 also includes a second or top surface 46 from which the grip portion 40 is configured to extend. The grip portion 40 may be integrally formed with the top surface 46 of the base 42 using any known method such as adhering or laminating only a portion of a second material layer onto a substrate layer, thus the portion of the second material layer that is not adhered is free to move and grasp. Alternatively, the grip portion 40 may be attached or coupled thereto by an adhesive or other attachment or affixation means. As is known in the art, the grip portion 40 may be configured and oriented such that it can be pivoted from a first or stowed position in which the grip portion 40 is substantially flush with the top surface 46, to a second or deployed positon in which the grip portion 40 extends from the top surface 46 at a non-zero angle. As discussed above with respect to the embodiment illustrated in FIG. 2, the grip portion 40 may be manipulated to assess the presence or absence of vacuum in the package 10 associated with the container closure 14.

Figure 4:
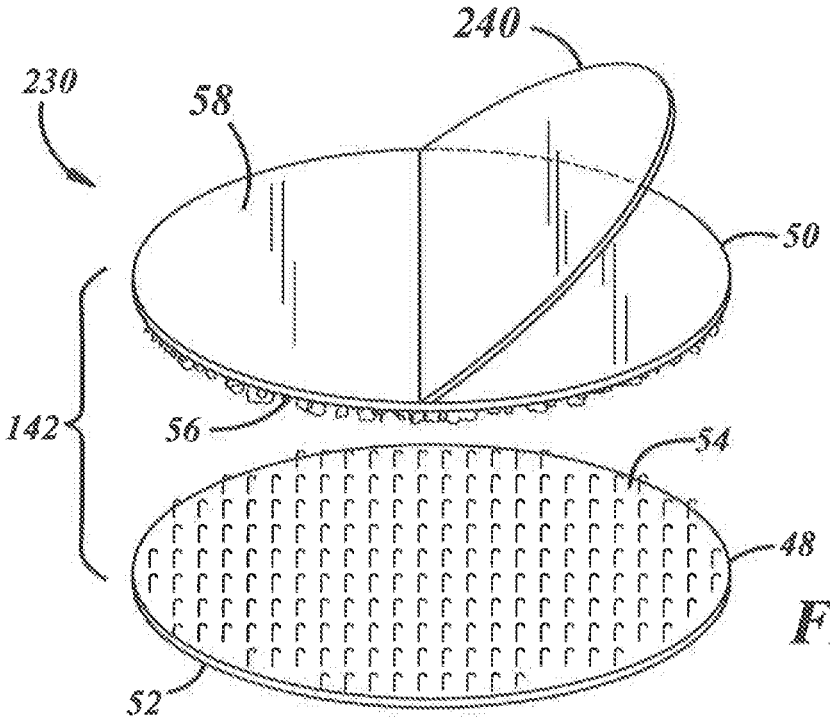

FIG. 4 depicts yet another illustrative embodiment of a pull tab (i.e., pull tab 230 in FIG. 4). Like the embodiment illustrated in FIG. 3, the pull tab 230 shown in FIG. 4 includes a base portion (i.e., base portion 142 in FIG. 4) and a grip or graspable portion (i.e., grip portion 240 in FIG. 4). In this embodiment, however, the base portion 142 is comprised of a first or bottom piece 48 and a second or top piece 50. The bottom piece 48 has a first or bottom surface 52 configured to be attached or affixed to the seal membrane 28 (FIG. 1) of the container 12 (FIG. 1) by an adhesive, fastener, or other suitable attachment or affixation means. The bottom piece 48 also has a second or top surface 54 configured for coupling the bottom piece 48 to the top piece 50 of the base 142.

Similarly, the top piece 50 of the base 142 has a first or bottom surface 56 configured for coupling the top piece 50 to the bottom piece 48 of the base 142, and a second or top surface 58 from which the grip portion 240 of the pull tab 230 is configured to extend. As with the other embodiments described above, the grip portion 240 may be integrally formed with the top surface 58, or may be attached or coupled thereto by an adhesive or other attachment or affixation means. As is known in the art, the grip portion 240 may be configured and oriented such that it can be pivoted from a first or stowed position in which the grip portion 240 is substantially flush with the top surface 58, to a second or deployed positon in which the grip portion 240 extends from the surface 58 at a non-zero angle. As discussed above, the grip portion 240 may be manipulated to assess the presence or absence of vacuum in the package 10 associated with the container closure 14.

As briefly described above, the top surface 54 of the bottom piece 48 of the base 142 is configured to be engaged with the bottom surface 56 of the top piece 50 in order to couple the bottom and top pieces 48, 50 of the base 142 together. In an embodiment, the top surface 54 and bottom surface 56 may be configured to be coupled together with an adhesive applied to one or both of the top surface 54 of the bottom piece 48 and the bottom surface 56 of the top piece 50. In another embodiment, complementary portions of a mechanical fastener may be disposed on the top surface 54 and bottom surface 56, respectively, that when engaged with each other couple the bottom and top pieces 48, 50 together. An example of such a fastener is a hook and loop fastener. Alternatively, any other suitable attachment or affixation means may be used to couple the bottom and top pieces together.

Turning back to FIG. 1, in addition to the seal membrane 28 and vacuum-indicating pull tab 30, in an embodiment the container closure 14 further includes a seal- or seal membrane-removing pull tab 60 extending from the seal membrane 28 that can be manipulated to remove the seal membrane 28 from the container 12. More particularly, as the pull tab 60 is pulled in a direction away from the container 12, the seal membrane 28 is caused to separate from the sealing surface 26 of the container 12, thereby breaking the seal between the seal membrane 28 and the container 12 and providing access to the product packaged therein. In an embodiment, the pull tab 60 extends from the outer edge or periphery 32 of the seal membrane 28. In other embodiments, however, the pull tab 60 may be located radially-inward of the outer edge 32 of the seal membrane 28. Further, in an embodiment, the pull tab 60 is integrally formed with the seal membrane 28 (e.g., the pull tab 60 is formed when the seal membrane is formed (e.g., cut) into the appropriate shape), whereas in other embodiments the pull tab 60 may be separately formed and attached or coupled to the seal membrane 28 using any suitable attachment or affixation means.

By way of example and illustration, FIGS. 5-7B show how a pull tab of a container closure of the present disclosure can be used to provide an indication of the presence or absence of a vacuum in the package 10. While FIGS. 5-7B and the description below are with respect to the embodiment of the pull tab illustrated in FIG. 4 (i.e., pull tab 230), it will be appreciated that the description below generally applies to other embodiments of the pull tab, including, but not limited to, those described herein.

Figure 5:
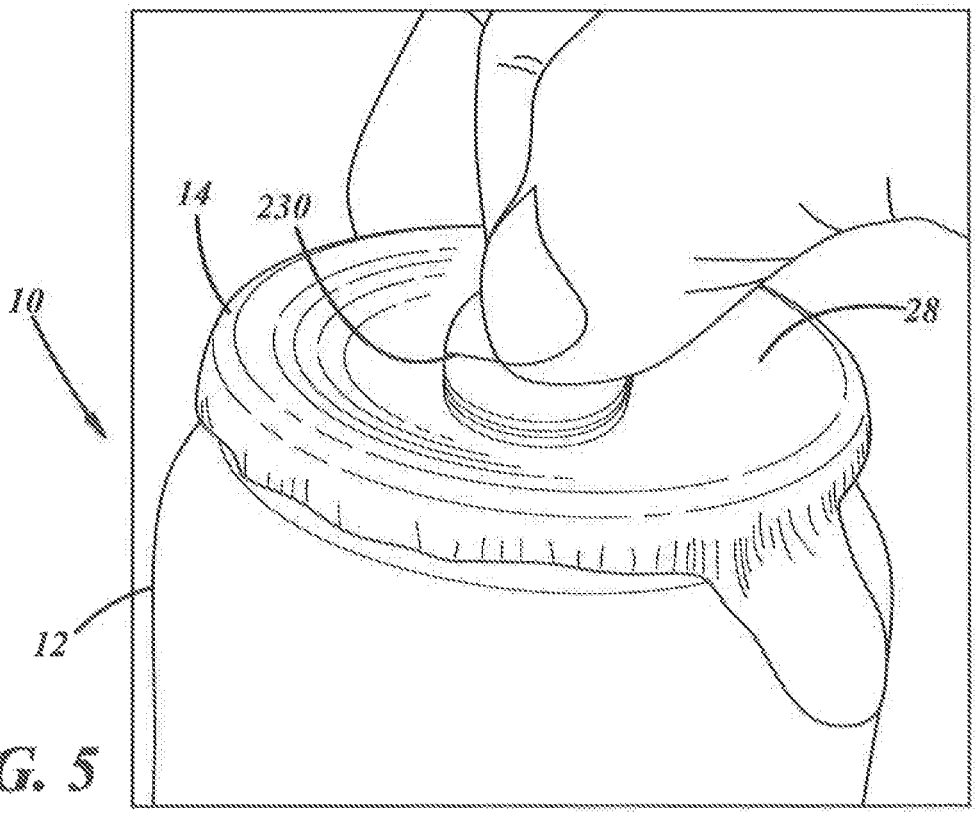
FIG. 5 is an isometric view of a portion of a package that includes a container and a container closure having the illustrative embodiment of the vacuum-indicating pull tab illustrated in FIG. 4 showing the manipulation of the vacuum-indicating pull tab.
Figure 6A:
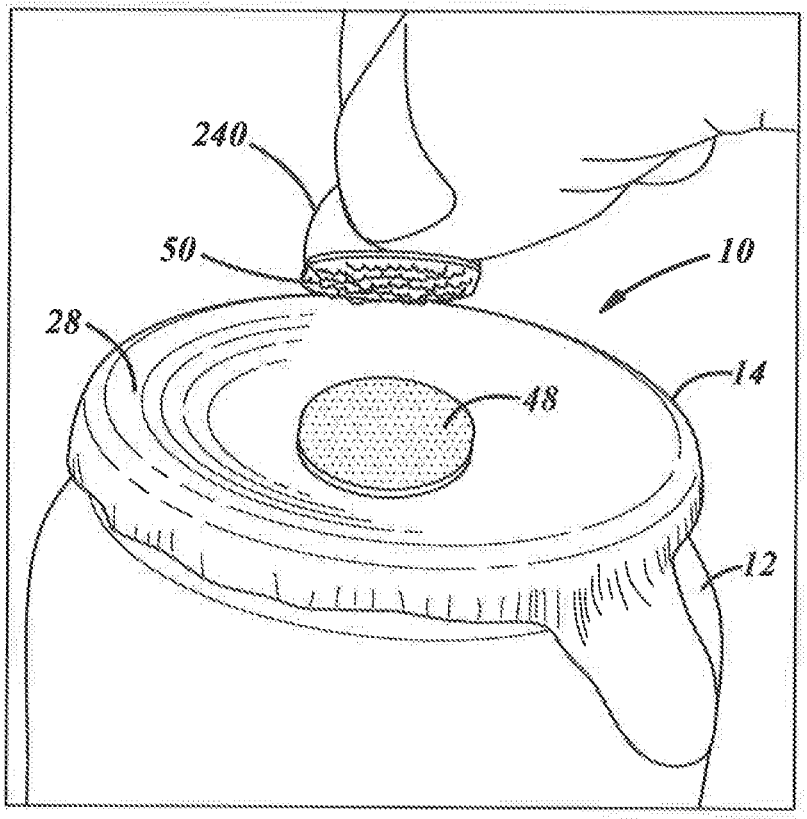
FIGS. 6A and 6B are isometric views of a portion of a package that includes a container and a container closure having the illustrative embodiment of the vacuum-indicating pull tab illustrated in FIGS. 4 and 5, wherein a vacuum is present in the package.
Figure 6B:
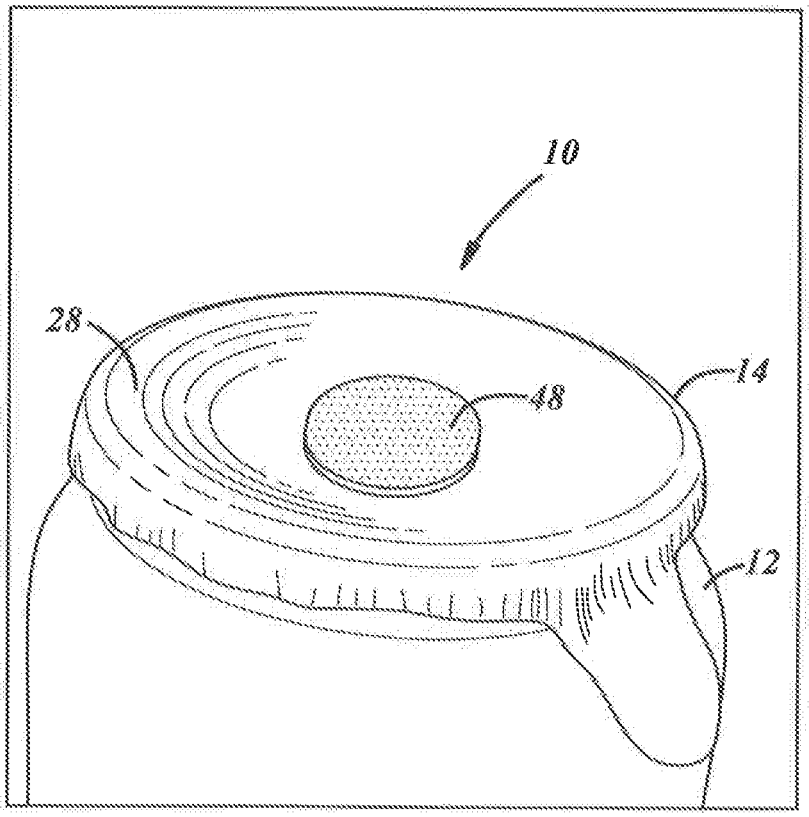
Figure 7A:
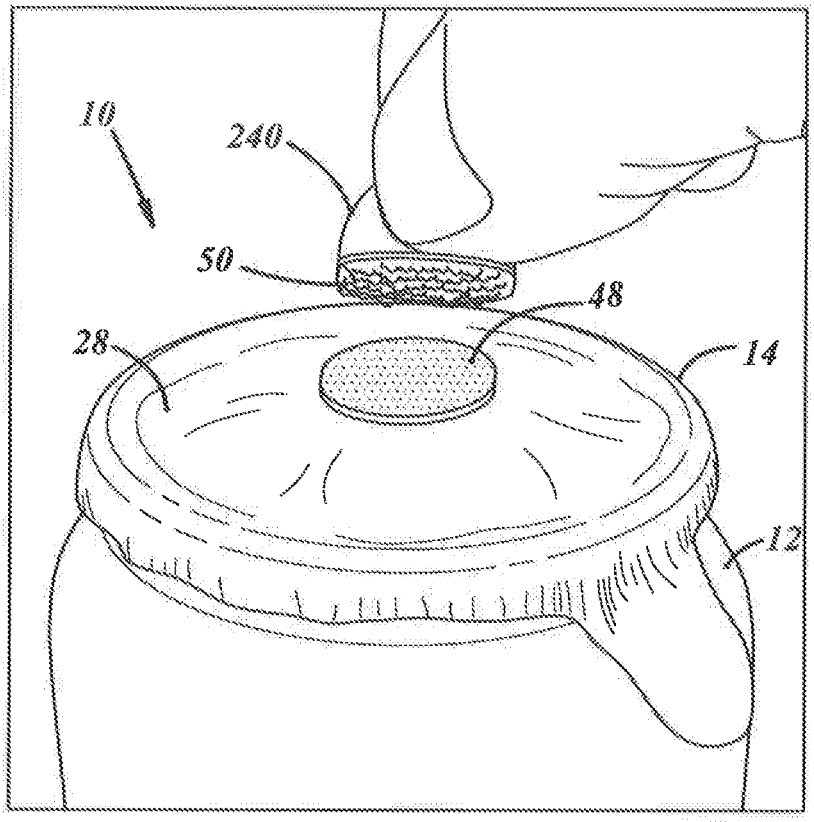
FIGS. 7A and 7B are isometric views of a portion of a package that includes a container and a container closure having the illustrative embodiment of the vacuum-indicating pull tab illustrated in FIGS. 4 and 5, wherein a vacuum is absent from the package.
Figure 7B:
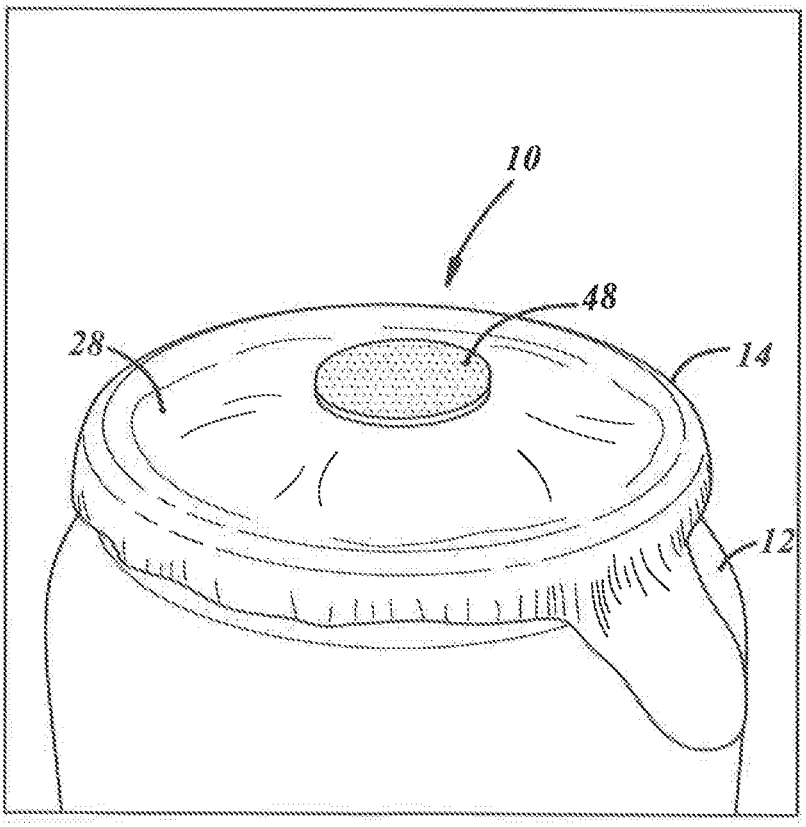

As shown in FIG. 5, the pull tab 230 is pulled in a direction away from the seal membrane 28. If, as the pull tab 230 is pulled and after the pull tab 230, or a portion thereof (e.g., top piece 50 of the base 142), releases or separates from the seal membrane 28 (if applicable), the seal membrane 28 maintains its concave parabolic shape, it can be determined that a vacuum is present in the package 10. Conversely, if the pulling of the pull tab 230 causes the seal membrane 28 to become deformed or to assume a shape other than the original concave parabolic shape, it can be determined that the vacuum inside the package 10 has been lost or is otherwise absent from the package 10.

Figure 8:
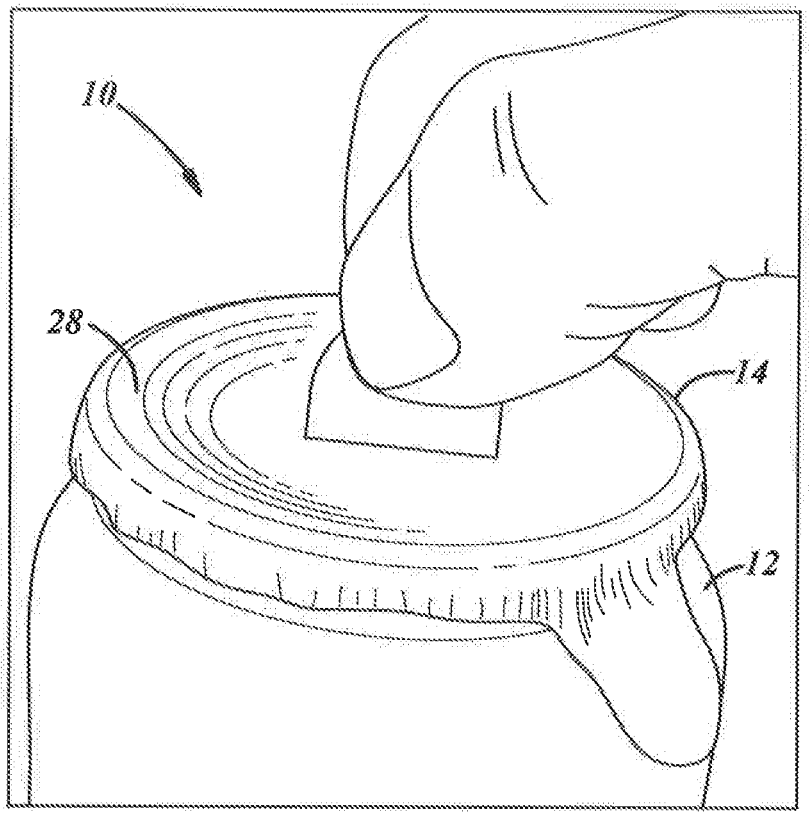
Figure 9:
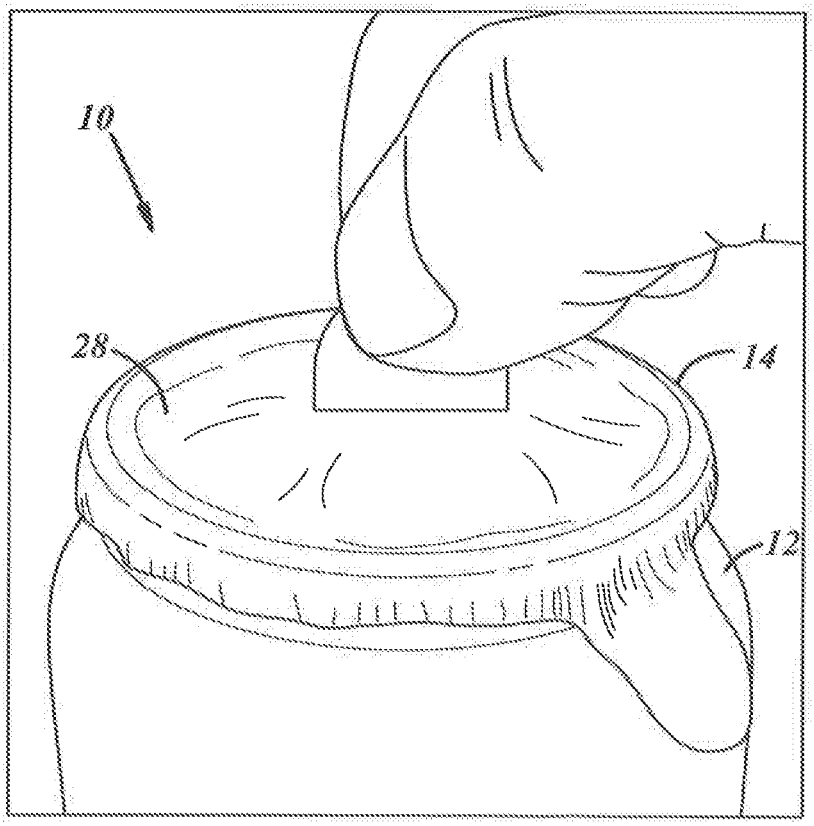

FIGS. 8 and 9 show another example of how a pull tab 30 of a container closure can be used to provide an indication of the presence or absence of a vacuum in the package 10. In this example, the pull tab 30 is integrally formed with or fixedly coupled to the seal membrane 28 (i.e., the pull tab is not releasable therefrom without the application of a force that would cause the seal membrane 28 to separate from the sealing surface 26). As with the example described above, the pull tab 30 is pulled in a direction away from the seal membrane 28. If, as shown in FIG. 8, the seal membrane 28 maintains its concave parabolic shape as the pull tab 30 is pulled, it can be determined that a vacuum is present in the package 10. On the other hand, if, as shown in FIG. 9, the seal member 28 becomes deformed or assumes a shape other than the original concave parabolic shape as the pull tab 30 is pulled, it can be determined that the vacuum inside the package has been lost or is otherwise absent from the package 10.

There thus has been disclosed a closure for a container that allows for a determination to be made as to whether or not a vacuum is present or absent from the package, and therefore, that fully satisfies one or more of the objects and aims previously set forth. The disclosure has been presented in conjunction with several illustrative embodiments, and additional modifications and variations have been discussed. Other modifications and variations readily will suggest themselves to persons of ordinary skill in the art in view of the foregoing discussion. For example, the subject matter of each of the embodiments is hereby incorporated by reference into each of the other embodiments, for expedience. The disclosure is intended to embrace all such modifications and variations as fall within the spirit and broad scope of the appended claims.

The invention claimed is:

1. A package that includes:

a container including a longitudinal axis extending therethrough and having a mouth and a sealing surface; and a container closure comprising:

a seal membrane comprising a foil membrane that is sealingly and removably coupled to said sealing surface of said container to seal said container; and a pull tab configured to extend from said seal membrane and coaxially aligned with or overlapping the longitudinal axis, wherein manipulation of said pull tab provides a loss of concave parabolic shape of the seal membrane when there is an absence of a vacuum in said package.

2. The package of claim 1, wherein at least a portion of said pull tab is releasably attached to said seal membrane.

3. The package of claim 1, wherein said pull tab comprises a base portion and grip portion, said base portion being attached to said seal membrane.

4. The package of claim 3, wherein said base portion has a first piece and a second piece configured to be releasably attached to said first piece, and further wherein said first piece of said base is attached to said seal membrane, and said grip portion of said pull tab is configured to extend from said second piece of said base.

5. The package of claim 4, wherein said second piece of said base is releasably attached to said first piece by a mechanical fastener.

6. The package of claim 4, wherein said second piece of said base is releasably attached to said first piece by an adhesive.

7. The package of claim 1, wherein said pull tab is integrally formed with said seal membrane.

8. The package of claim 1, wherein said pull tab is fixedly coupled to said seal membrane.

9. The package of claim 1, wherein said pull tab is located radially-inward of an outer edge of said seal membrane.

10. The package of claim 1, wherein said pull tab comprises a base portion configured to attach to said seal membrane and a grip portion extending from the base portion, and further wherein manipulation of said grip portion causes said seal membrane to be separated from said sealing surface.

11. The package of claim 10, wherein said grip portion is integrally formed with said seal membrane.

12. A food or beverage container closure, comprising:

a seal membrane comprising a foil membrane configured to be removably coupled to a sealing surface of a container; and a pull tab configured to extend from said seal membrane and coaxially aligned with or overlapping a longitudinal axis extending through the container, and configured to provide a loss of concave parabolic shape of the seal membrane when there is an absence of a vacuum in the container.

13. The container closure of claim 12, wherein at least a portion of said pull tab is releasably attached to said seal membrane.

14. The container closure of claim 12, wherein said pull tab comprises a base portion and grip portion, said base portion is attached to said seal membrane.

15. The container closure of claim 14, wherein said base portion has a first piece and a second piece configured to be releasably attached to said first piece, and further wherein said first piece of said base is attached to said seal membrane, and said grip portion of said pull tab is configured to extend from said second piece of said base.

16. The container closure of claim 15, wherein said second piece of said base is releasably attached to said first piece by a mechanical fastener.

17. The container closure of claim 15, wherein said second piece of said base is releasably attached to said first piece by an adhesive.

18. The container closure of claim 12, wherein said pull tab is integrally formed with said seal membrane.

19. The container closure of claim 12, wherein said pull tab is fixedly coupled to said seal membrane.

20. The container closure of claim 12, wherein said pull tab is located radially-inward of an outer edge of said seal membrane.

21. The container closure of claim 12, wherein said pull tab comprises a base portion and said seal membrane includes a grip portion extending from the base portion.

22. A package that includes:

a container including a longitudinal axis extending therethrough and having a mouth and a sealing surface; and a container closure comprising:

a seal membrane sealingly and removably coupled to said sealing surface of said container to seal said container; and a pull tab configured to extend from said seal membrane at a location that is radially-inward of an outer edge of said seal membrane, wherein at least a portion of said pull tab is releasably attached to said seal membrane, wherein said container has a product packaged therein that creates a vacuum in said package that draws said seal membrane into a parabolic shape, and further wherein manipulation of said pull tab provides an indication of the presence or absence of vacuum in said package.

23. A package that includes:

a container including a longitudinal axis extending therethrough and having a mouth and a sealing surface; and a container closure comprising:

a seal membrane comprising a foil membrane that is sealingly and removably coupled to said sealing surface of said container to seal said container; and a pull tab configured to extend from said seal membrane, wherein said pull tab is located radially-inward of an outer edge of said seal membrane, wherein manipulation of said pull tab provides a loss of concave parabolic shape of the seal membrane when there is an absence of a vacuum in said package.

24. A package that includes:

a container including a longitudinal axis extending therethrough and having a mouth and a sealing surface; and a container closure comprising:

a seal membrane comprising a foil membrane that is sealingly and removably coupled to said sealing surface of said container to seal said container; and a pull tab configured to extend from said seal membrane, wherein said pull tab comprises a base portion configured to be affixed to said seal membrane and a grip portion extending from the base portion, and wherein manipulation of said grip portion causes said seal membrane to be separated from said sealing surface, wherein manipulation of said pull tab provides a loss of concave parabolic shape of the seal membrane when there is an absence of a vacuum in said package.

25. A food or beverage container closure, comprising:

a seal membrane comprising a foil membrane configured to be removably coupled to a sealing surface of a container; and a pull tab integrally formed with and configured to extend from said seal membrane, and configured to provide a loss of concave parabolic shape of the seal membrane when there is an absence of a vacuum in the container.

26. The package of claim 1, wherein the pull tab is affixed to the seal membrane with an adhesive that is weaker than an adhesive which seals the seal membrane to the sealing surface.

27. The package of claim 1, wherein an outer diameter of the pull tab is less than an outer diameter of the seal membrane, and wherein the pull tab overlaps a center of the seal membrane such that when the seal membrane is coupled with the container the pull tab overlaps the longitudinal axis of the container.

28. The package of claim 1, wherein, upon the manipulation of the pull tab, the concave parabolic shape of the sealing membrane will remain if vacuum remains within the package, but the sealing membrane will deform into a convex parabolic shape if vacuum no longer remains within the package.

* * * * *